US005779866A

United States Patent [19]

Tarancon

[11] Patent Number: 5,779,866

[45] Date of Patent: Jul. 14, 1998

[54] ELECTROLYZER

[75] Inventor: Gregorio Tarancon, High Springs, Fla.

[73] Assignee: Florida Scientific Laboratories Inc., High Springs, Fla.

[21] Appl. No.: 757,619

[22] Filed: Nov. 26, 1996

[51] Int. Cl.[6] ..... C25B 9/00; C25B 15/08

[52] U.S. Cl. ..... 204/262; 204/266; 204/292; 204/293; 204/294; 204/295

[58] Field of Search ..... 204/256, 258, 204/263–266, 278

[56] References Cited

U.S. PATENT DOCUMENTS

| | | | |
|---|---|---|---|
| 3,761,221 | 9/1973 | Stillions | 204/278 X |
| 4,555,323 | 11/1985 | Collier | 204/258 |
| 4,701,265 | 10/1987 | Carlson et al. | 204/278 X |
| 5,211,828 | 5/1993 | Shkarvand-Moghaddam | 204/266 |
| 5,690,797 | 11/1997 | Harada et al. | 204/266 X |

*Primary Examiner*—Donald R. Valentine

*Attorney, Agent, or Firm*—Ezra Sutton

[57] ABSTRACT

An electrolyzer, including a lower electrolyte chamber for receiving liquid electrolyte flux and having disposed therein anode and cathode electrodes for producing anodic and cathodic gases. A first barrier is disposed in the lower electrolyte chamber between the anode and cathode electrodes having a plurality of V-shaped passageways for allowing the passage of electrons but for preventing the recombination of anodic and cathodic gases. The electrolyzer also includes an upper gas chamber having an anodic gas compartment and a cathodic gas compartment for receiving therein the anodic and cathodic gases produced in the lower electrolyte chamber. The upper gas chamber includes a second barrier disposed between the anodic and cathodic gas compartments having no passageways in order to prevent the recombination of anodic and cathodic gases. The second barrier is connected to the first barrier. In addition, the electrolyzer further includes means for transferring the anodic and cathodic gases produced in the anodic and cathodic gas compartments to holding tanks for storing of the anodic and cathodic gases.

29 Claims, 9 Drawing Sheets

ELECTROLYZER

FILED OF THE INVENTION

This invention relates to an electrolyzer, and more particularly, to an upper liquid/gas chamber to be added to the top of the electrolyzer to allow a higher pressure differential between the anodic and cathodic gas compartments, and to a lower chamber for receiving liquid electrolyte having a divider with V-shaped passageways to prevent the recombination of the anodic and the cathodic gases, but which allows the passage of electrons (electron ions) between the electrode compartments without changing the electrical resistance between the electrodes, so that the electrolyzer operates more efficiently and with a higher degree of safety.

BACKGROUND OF THE INVENTION

The electrolyzers that are commercially used for manufacturing anodic gases (oxidizers), such as fluorine, chlorine, oxygen, ozone, etc. and cathodic gases (reducers), such as hydrogen and deuterium, are subject to safety problems with respect to the potential contact between the anodic gas (oxidizer) and the cathodic gas (reducer). Such contact may cause heat generation, explosions, and decrease the efficiency. There are many additional safety concerns with regard to the operation of present day electrolyzers. In the event of any malfunctions of the downstream flow devices, such as gas pumps (compressors) and gas control valves, these may cause instantaneous pressure fluctuations in the gas compartments of the electrolyzer which in turn could rupture the seal between the two gas compartments and gas would flow from one compartment to the other compartment and result in an explosion. One area where potential contact between the two gases may occur is at the baffle between the two chamber compartments and in the liquid electrolyte. Many of the electrolyzers disclosed in the prior art have the electrodes mounted on top of the electrolyzer, thus limiting the depth of the liquid electrolyte. An electrolyzer with the electrodes mounted from the bottom or the sides of the electrolyzer prevents corrosion of the electrodes at the current input point. Another area where potential contact between the two gases may occur is across the front of the electrodes. Several dividers are disclosed in the prior art but none act as a completely satisfactory gas barrier. Also, such dividers cause electrical resistance between the two electrodes which adds to the manufacturing costs in producing the gases, such as fluorine and hydrogen gases.

These prior art barriers are in the form of plastic meshes, metal screens and permeable membranes. In using plastic mesh-type barriers the gas molecules can accumulate and recombine at the mesh surface. If the gas accumulation is significantly high near the mesh surface areas, recombination of the oxidizer and reducer gases may result in small explosions and burn the plastic mesh surfaces. Plastic mesh-type barriers can only be used in special cases where the hazard of gas recombination does not present a significant problem. Metal screens or wire mesh-type barriers introduce bipolar characteristics to the electrolyzer by generating undesirable parasitic electrolyte flux currents between the anodic and cathodic electrodes, thereby reducing electrolyzer performance and efficiency. Permeable membranes or ion exchange polymeric membranes are generally used in chlorine or other oxidizer gas electrolyzers. However, these membranes introduce significant resistance for the electron or reactive ion transport between the electrodes and generate heat in the electrolyzer resulting in poor utilization of current for generating gases. The life of this type of ion transport membrane is very short in an anhydrous electrolyte environment.

There remains a need for an improved electrolyzer having high safety standards and that prevents contact between the anodic and cathodic gases by having an upper liquid/gas chamber which allows a maximum pressure differential between the gas compartments for the prevention of an explosion; and a second barrier that prevents contact between the anodic and cathodic gases in the bottom liquid chamber, and does not introduce electrical resistance between the electrodes.

DESCRIPTION OF THE PRIOR ART

Fluorine electrolyzers of various designs, configurations and materials of construction have been disclosed in the prior art. For example, U.S. Pat. No. 3,930,151 discloses a multiple vertical diaphragm electrolytic cell having gas-bubble guiding partition plates. U.S. Pat. No. 4,059,500 discloses an electrode unit having a current-distribution support for the electrolysis of halogenoid solutions. U.S. Pat. No. 4,377,455 discloses a V-shaped sandwich type cell with reticulate electrodes for use in electrolytic cells for the electrolysis of alkali metal halides. U.S. Pat. No. 4,469,577 discloses a membrane electrolysis cell for the production of a halogen and hydrogen by electrolyzing an aqueous halide brine. U.S. Pat. No. 4,950,370 discloses an electrolytic gas generator for producing fluorine and hydrogen gases that has an improved efficiency by reducing the resistance between the anode and the cathode.

None of the aforementioned prior art patents disclose an electrolyzer having two different barriers in the electrolyzer.

Accordingly, it is an object of the present invention to provide an improved electrolyzer having an upper liquid/gas chamber with anodic and cathodic gas compartments being separated by a solid barrier, and a lower liquid electrolyte chamber having a barrier with V-shaped passageways such that the electrolyzer is operated with improved safety, capacity, and savings in operational cost for the manufacture of fluorine and other anodic gases (oxidizers) and by having less downtime.

Another object of the present invention is to provide an improved electrolyzer having a barrier in the electrolyte chamber that prevents explosions, such that the barrier prevents the recombination of the anodic and cathodic gases within the electrolyte solution and/or near the electrodes.

Another object of the present invention is to provide an improved electrolyzer having a barrier in the electrolyte chamber with a plurality of V-shaped passageways which allows for the free flow of electrons required for the electrolysis via active electrolyte reactant ions without introducing electrical resistance, but prevents the recombination of anodic and cathodic gases.

Another object of the present invention is to provide an improved electrolyzer having a barrier in the form of a tunnel electron net divider in the electrolyte chamber made of a polymeric material such as polyethylene, polypropylene, polytetrafluoroethylene, polyvinylidine fluoride and the like, and which may be incorporated into any electrolyzer that is charged with any type of electrolyte (hydrous or anhydrous) solutions.

Another object of the present invention is to provide an improved electrolyzer for the manufacture and production of chemical gases (fluorine, nitrogen trifluoride and hydrogen), such that a change in liquid levels in the electrolyzer will allow a greater pressure differential between the gas compartments and prevent a rupture of the barrier between the gas compartments.

Another object of the present invention is to provide an improved electrolyzer having a lower liquid electrolyte chamber with electrode connections at the bottom or on the sides of the electrolyzer wall which provides the necessary height for the liquid electrolyte above the electrodes, and which allows for a sufficient pressure differential pressure between the two gas compartments in which to operate safely but also prevents corrosion at the anodic current input point.

Another object of the present invention is to provide an improved electrolyzer having an upper liquid/gas chamber with a cooling zone above the electrodes that reduces the anodic gas temperature and also allows the electrolyte flux solution temperature to be controlled.

Another object of the present invention is to provide an improved electrolyzer having upper liquid gas chamber with connections for gaseous streams, electronic sensors, and instruments.

Another object of the present invention is to provide for an improved electrolyzer having an upper gas chamber with a solid barrier which allows for maximum pressure differential (AP) and minimizes the possibility of any recombination of the anodic and cathodic gases that could cause an explosion.

A further object of the present invention is to provide an improved electrolyzer having an external heat exchanger/transfer mixing tank to maintain a uniform electrolyte composition near the electrode area resulting in uniform electroconductivity.

An even further object of the present invention is to provide an improved electrolyzer that is simple to manufacture and assemble; more cost efficient in operational use than previously used electrolyzers; and is readily affordable by the gas manufacturer/producer.

SUMMARY OF THE INVENTION

In accordance with the present invention there is provided an electrolyzer that includes a lower liquid electrolyte chamber for receiving liquid electrolyte flux and having disposed therein anode and cathode electrodes for producing anodic and cathodic gases. A first barrier is disposed in the lower liquid electrolyte chamber between the anode and cathode electrodes having a plurality of V-shaped passageways for allowing the passage of electrons but for preventing the recombination of anodic and cathodic gases. The electrolyzer also includes an upper liquid/gas chamber having an anodic gas compartment and a cathodic gas compartment for receiving therein the anodic and cathodic gases produced in the lower liquid electrolyte chamber. The upper liquid/gas chamber includes a solid baffle disposed between the anodic and cathodic gas compartments. The solid baffle is connected to the first barrier which is a tunnel electron net. In addition, the electrolyzer further includes means for transferring the anodic and cathodic gases produced in the anodic and cathodic gas compartments to holding tanks for storing of the anodic and cathodic gases.

The first barrier or tunnel electron net is made of a polymeric compound selected from the group consisting of polyethylene, polypropylene, polytetrafluoroethylene, polyvinylidine fluoride and equivalent polymeric compounds thereof. In addition, the first barrier is made of plates arranged parallel to each other and includes upper and lower plate holders for connecting the plates at different spaced-apart distances.

The second barrier is a solid baffle and is made of plastic or a metal selected from the group consisting of nickel, nickel alloy, monel, stainless steel, Hastelloy, carbon steel, and Inconel. The second barrier solid baffle is made of the same material as the upper liquid/gas chamber which is able to withstand a pressure greater than maximum pressure differential (AP) between the anodic gas compartment and the cathodic gas compartment.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
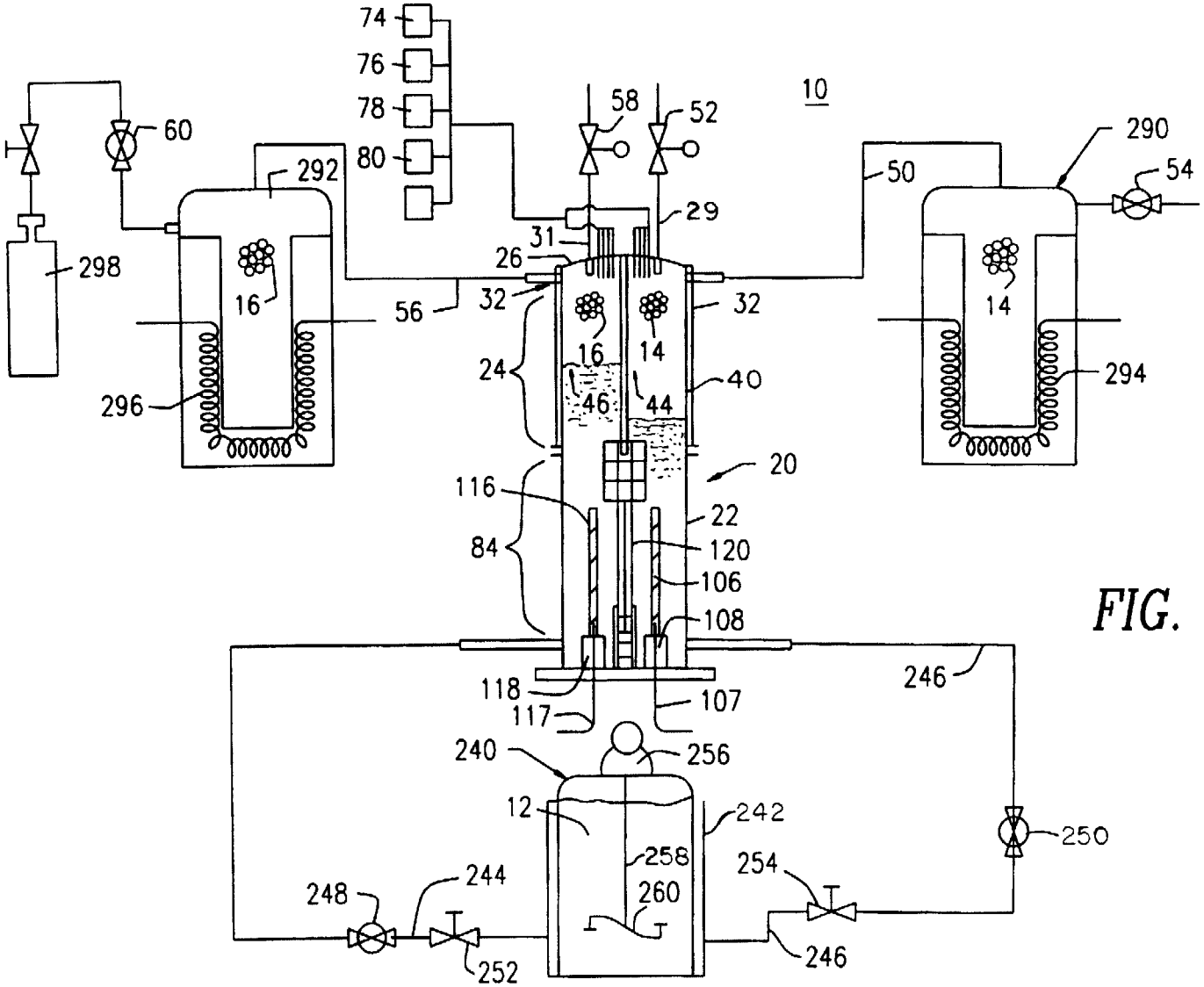
FIG. 1 is a side view schematic of the fluorine electrolyzer of the preferred embodiment of the present invention showing the improved fluorine electrolyzer system with all major components being shown.

The improved fluorine electrolyzer 10 of the preferred embodiment of the present invention is represented in FIGS. 1 through 14 of the drawings, and is used for the safe and economical production of fluorine gas ($F_2$) 14 and hydrogen ($H_2$) 16 from an electrolyte flux solution 12. Fluorine electrolyzer 10, as shown in FIG. 1, includes an electrolyzer chamber 20 for producing the fluorine ($F_2$) 14 and hydrogen ($H_2$) 16 gases; and an external heat exchanger and mixing tank 240 for supplying flux solution 12 to the electrolyzer chamber 20; a fluorine (anodic gas) storage holding tank 290 having a coolant system 294 for receiving the fluorine gas ($F_2$) 14; and a hydrogen (cathodic gas) storage holding tank 292 having a coolant system 296 for receiving the hydrogen ($H_2$) 16.

Figure 2:
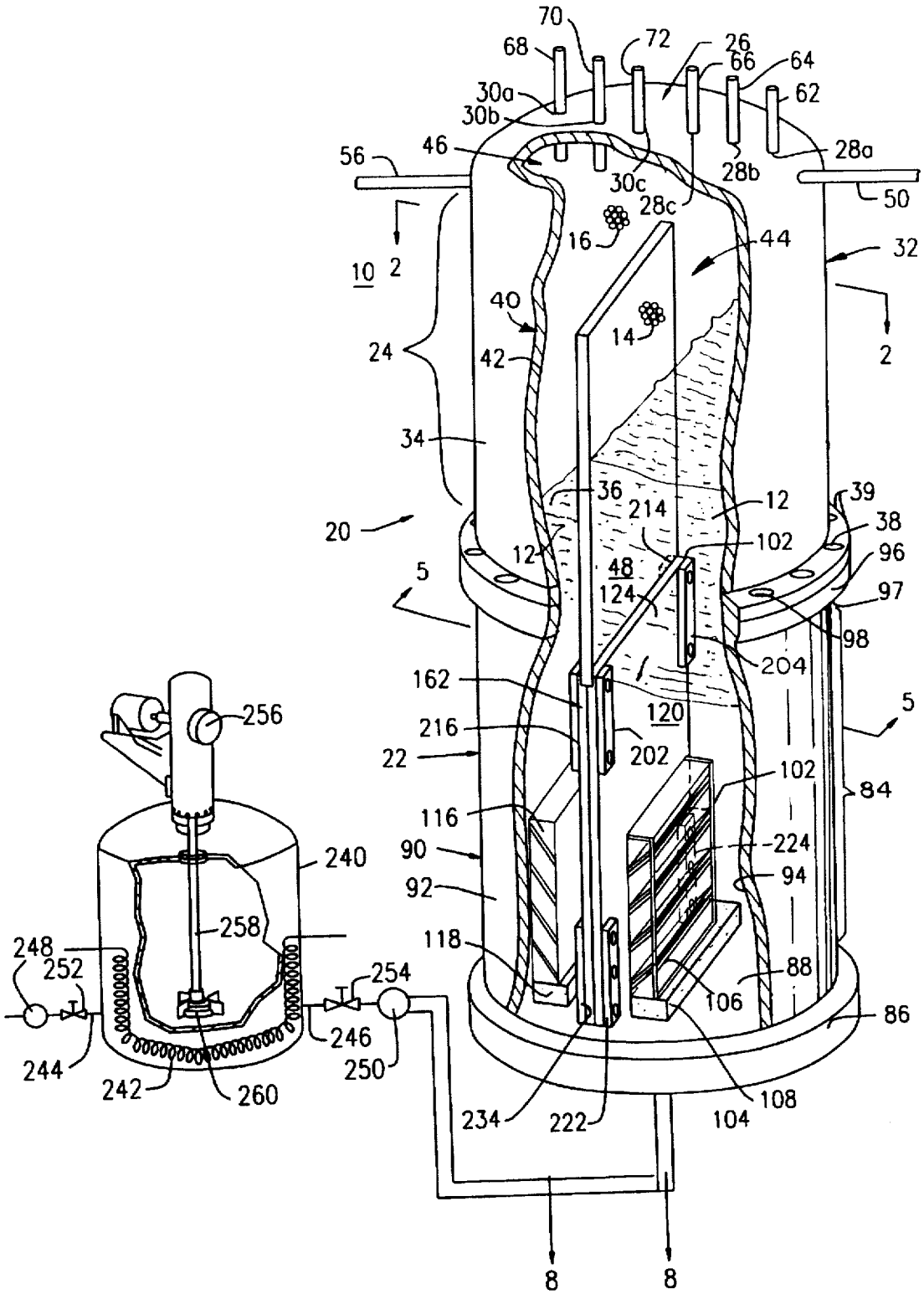
FIG. 2 is a break-away perspective view of the fluorine electrolyzer of the preferred embodiment of the present invention showing the chambers, the sensors, the barriers, and the electrodes within the electrolyzer; and the external heat exchanger/transfer mixing tank.
Figure 3:
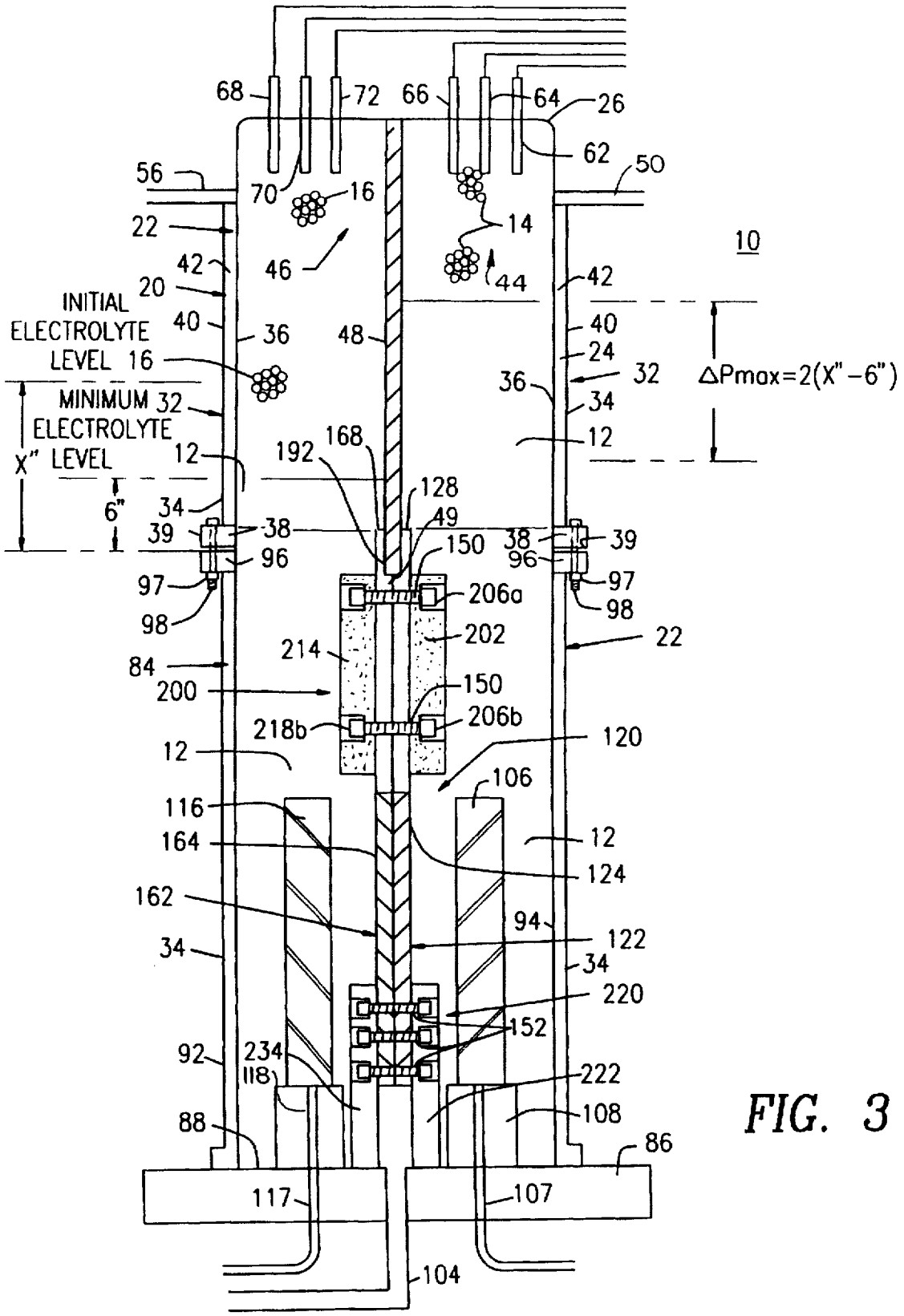
FIG. 3 is a cross-sectional view of the fluorine electrolyzer taken along lines 2—2 of FIG. 1 of the present invention showing the major internal component parts contained therein; and also showing the maximum allowable pressure differential between the anodic and cathodic compartments under normal electrolyzer working conditions from the anodic side.
Figure 4:
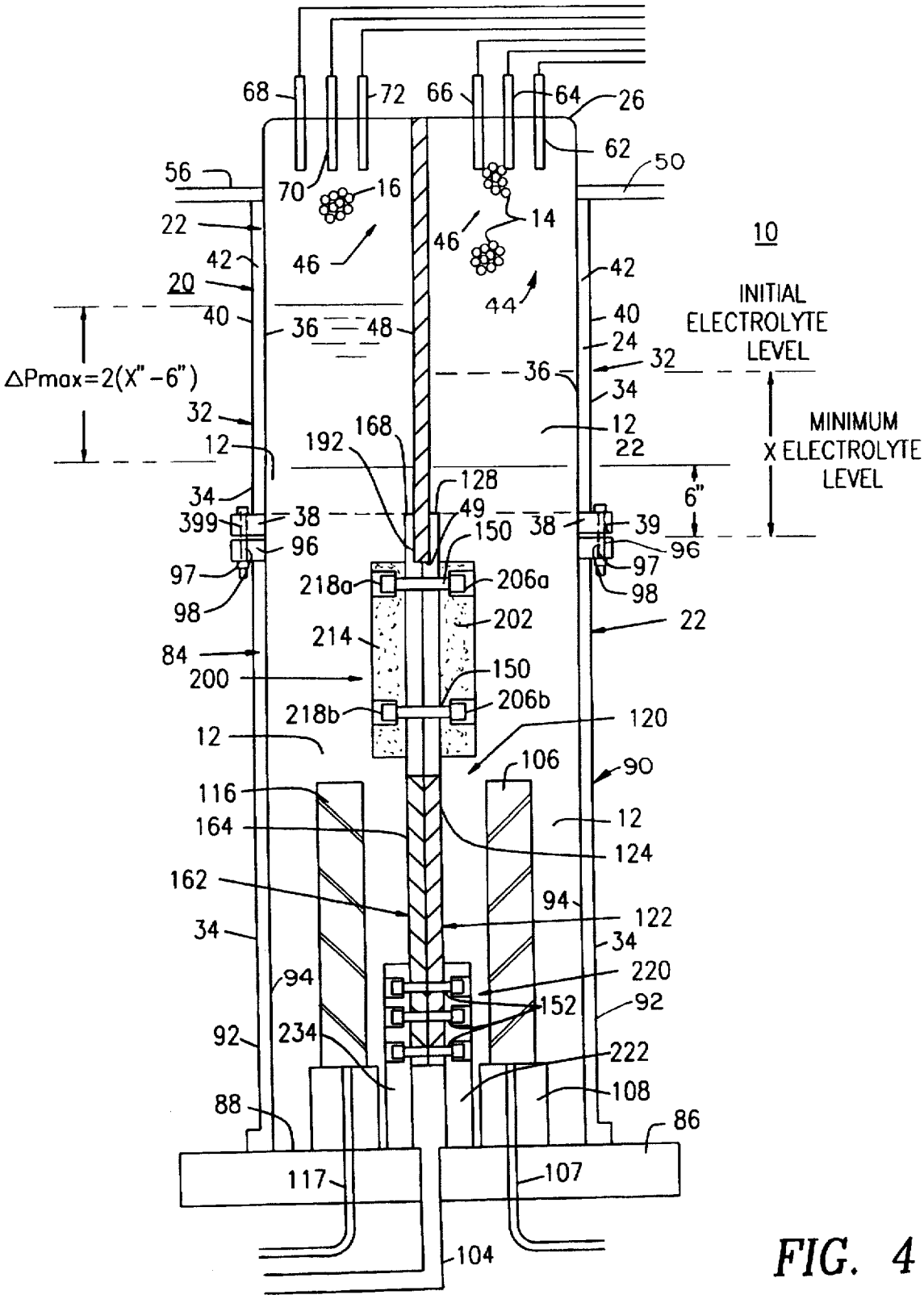
FIG. 4 is a cross-sectional view of the fluorine electrolyzer taken along lines 2—2 of FIG. 1 of the present invention showing the major internal component parts contained therein; and also showing the maximum allowable pressure differential between the anodic and cathodic compartments under normal electrolyzer working conditions from the cathodic side.

Electrolyzer chamber 20, as shown in FIGS. 2, 3, and 4, includes a metal housing 22 having an upper liquid/gas chamber 24 which provides a liquid electrolyte seal or LES, to be explained below. Chamber 24 also has anodic and cathodic gas compartments 44 and 46 separated by a metal separator seal plate or solid barrier 48. Housing 22 also has a lower liquid electrolyte chamber 84 with an internal anode 106, a carbon steel cathode 116 and a barrier 120 with V-shaped passageways 190 referred to as a tunnel electron net ("TEN") divider 120 disposed between the anode 106 and cathode 116. The metal separator seal plate 48 prevents the recombination and/or contact of the anodic gas and the cathodic gas within the upper liquid/gas chamber 24. The tunnel electron net (TEN) divider 120 has a plurality of angled tunnels or channels 146 and 166 that cooperate to form V-shaped channels or passageways 190. They allow for the free flow of electrons within the electrolyte flux solution 12 in the lower liquid electrolyte chamber 84 which is required for the electrolysis via active electrolyte reactant ions in the flux solution 12 without introducing electrical resistance. The TEN divider 120 also prevents any recombination of the anodic fluorine gas ($F_2$) 14 and cathodic hydrogen gas ($H_2$) 16 within the lower electrolyte chamber 84 which would cause an explosion since the gases will not pass through the V-shaped passageways 190.

The upper liquid/gas chamber 24, as shown in FIGS. 1 to 4, includes a top wall cover 26 having sensor hole openings 28 for the anodic compartment side 44 and having sensor hole openings 30 for the cathodic compartment side 46; an upper wall section 32 having an outer surface wall 34 and an inner surface wall 36; an upper flange ring connection 38 with a plurality of hole openings 39 for bolts 98 for connecting the upper chamber 24 to the lower electrolyte chamber 84; and an external cooling jacket 40 for heating or cooling having a liquid 42. In addition, the top wall cover 26 further includes an outlet relief pipeline 29 having a relief safety valve 52 for the anodic gas compartment 44; and an outlet relief pipeline 31 having a relief safety valve 58 for the cathodic gas compartment 46. The anodic gas compartment 44 also includes an outlet pipeline 50 connected at its first end to the upper wall section 32 and connected at its second end to the anodic gas storage holding tank 290. The cathodic gas compartment 46 also includes an outlet pipeline 56 connected at its first end to the upper wall section 32 and connected at its second end to the cathodic gas storage holding tank 292.

The anodic gas compartment 44 includes anodic-side pressure, temperature, and ultra-sonic liquid level sensor probes 62, 64, and 66, respectively, for placement within sensor hole openings 28*a*, 28*b*, and 28*c* of top wall member 26. The cathodic gas compartment 46 includes cathodic-side pressure, temperature and ultra-sonic liquid level sensor probes 68, 70, and 73, respectively, for placement within sensor hole openings 30*a*, 30*b*, and 30*c* of top wall member 26. Instrumentation for adjusting the pressure, temperature, and liquid levels within each of the anodic and cathodic gas compartments 44 and 46 includes a pressure adjustment controller 74, a temperature adjustment controller 76, a liquid level adjustment controller 78, and a pressure differential analogue instrument 80 for analyzing the maximum allowable pressure differential $\Delta P_{max}$ within each of the anodic and cathodic gas compartments 44 and 46.

The lower liquid electrolyte chamber 84, as shown in FIGS. 1, 2, and 3, includes a bottom wall member 86 having an inner top surface wall 88; a lower cylindrical wall section 90 having an outer surface wall 92 and an inner surface wall 94; a lower flange ring connection 96 with a plurality of hole openings 97 for receiving bolts 98 for connecting the upper chamber 24 to the lower electrolyte chamber 84; a pair of vertical flanges 100 and 102 being integrally connected to the inner surface wall 94 and located 180° degrees opposed from each other for holding the TEN divider 120 in place; and inlet and outlet flux lines 244 and 246 for electrolyte flux solution 12. Lower liquid electrolyte chamber 84 further includes the nickel anode electrode 106 and the carbon steel cathode electrode 116 being mounted on ultra-high molecular weight (MW) polyethylene bases 108 and 118. Bases 108 and 118 may be formed of any suitable insulating material such as Teflon or Tefzel. The electrodes 106 and 116 used in the present invention are of the type disclosed in U.S. Pat. No. 5,366,606. Bases 108 and 118 are integrally connected to inner top surface wall 88 of bottom wall member 86, and are separated by the TEN divider or barrier 120. The electrical current-input lead connections 107 and 117 for the anode and cathode electrodes 106 and 116 are connected through the bottom wall member 86 of lower electrolyte chamber 84 through the ultra high density polyethylene bases 108 and 118 to each of the electrodes 106 and 116, as shown in FIGS. 3 and 4 of the drawings. The gap or space between the electrodes 106 and 116 and the TEN divider barrier 120 was set at approximately one and one-quarter inches (1¼") for optimum electrolyte ion transfer through the V-shaped passageways 190 of TEN divider 120. However, the space may range from ¼" to 2". The TEN divider 120 includes a pair of anodic and cathodic perforated plates 122 and 162, respectively. The anodic-side perforated plate 122 includes a front surface 124; a rear surface 126; an upper L-shaped perimeter edge 128; outer perimeter side lip edges 130 and 132 having upper bolt openings 134*a*, 134*b*, 136*a* and 136*b* and lower bolt openings 138*a*, 138*b*, 138*c*, 140*a*, 140*b*, and 140*c*; and inner L-shaped side perimeter edges 142 and 144. The anodic side perforated plate 122 further includes a plurality of tunnels, perforations or slots 146 arranged in columns and rows, as shown in FIG. 4. Each tunnel 146 is at a downwardly angled position 148 having a 45° degree angle relative to the horizontal axis.

Figure 7A:
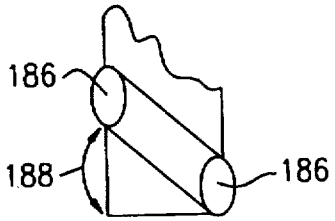
FIG. 7A is a cross-sectional perspective view of the fluorine electrolyzer taken along lines 7A—7A of FIG. 7 of the present invention showing the V-shaped passageways at a 45° angle in a single divider plate of the lower barrier.

The cathodic-side perforated plate 162 includes a front surface 164; a rear surface 166; an upper L-shaped perimeter edge 168; outer perimeter side lip edges 170 and 172 having upper bolt openings 174*a*, 174*b*, 176*a* and 176*b* and lower bolt openings 178*a*, 178*b*, 178*c*, 180*a*, 180*b*, and 180*c*; and inner L-shaped side perimeter edges 182 and 184. The cathodic side perforated plate 162 further includes a plurality of tunnels or slots 186 arranged in columns and rows. Each tunnel 186 is at a downwardly angled position 188 having a 45° degree angle relative to the horizontal axis, as shown in FIG. 7A.

The TEN divider 120, as previously stated, has perforation plates 122 and 162 having a plurality of perforations, slots, or tunnels 146 and 186 through the plates 122 and 162 at an angle with respect to the front surfaces 124 and 126 of both plates 122 and 162. The tunnel angle relative to the horizontal axis may be varied from 15° to 75° degrees, but a 45° angle relative to the horizontal axis is the preferred angle. The thickness of the TEN divider 120 (both plates 122 and 162 are parallel and adjacent to each other) has an overall range from one-eighth of an inch (⅛") to two inches (2"), with a preferred range between one-half of an inch (½") to one inch (1"). The slot or tunnel openings 146 and 186 have an overall range from one-sixteenth of an inch (1/16") to one-half of an inch (½") , with a preferred range between one-quarter of an inch (¼") to three-eighths of an inch (⅜"). The TEN divider 120 of the present invention has an overall width measurement of twenty-one inches (21"), an overall height measurement of twenty-eight inches (28") and an overall thickness measurement of one inch (1") for use in a twenty-four inch (24") diameter electrolyzer chamber 20. Each tunnel diameter is ⅜"×9/16" having a 45° angle across the thickness of perforation plates 122 and 162 where the number of tunnels per plate 122 and 162 are 600, arranged in thirty (30) columns with 20 tunnels per column along the height of about seventeen inches (17") starting from the bottom edge 198 of TEN divider 120.

When the TEN divider 120 is in an assembled state, as shown in FIGS. 2, 3, 4, 8, and 11, the tunnels 146 and 186 located on the rear surfaces 126 and 166 of each perforation plate 122 and 162 are placed together, such that tunnels 146 and 186 are adjacent and in contact with each other to form the V-shaped passageways 190. V-shaped passageways 190 allow for the free flow of electrons within the electrolyte flux solution 12, such that they do not limit the mobility of reactive ions from the anode 106 to the cathode 116 within the lower electrolyte chamber 84. The tunnel electron net (TEN) divider 120 in the electrolyte chamber 84 is made of a polymeric material such as polyethylene, polypropylene, polytetrafluoroethylene, polyvinylide fluoride and the like, and which may be incorporated into any electrolyzer that is charged with any type of electrolyte (hydrous or anhydrous) solutions. The TEN divider 120 when made from a polymeric material will not degrade but will remain intact for a long time in a corrosive anhydrous electrolyte environment which exists in the electrolyzer chamber 20.

Figure 10:
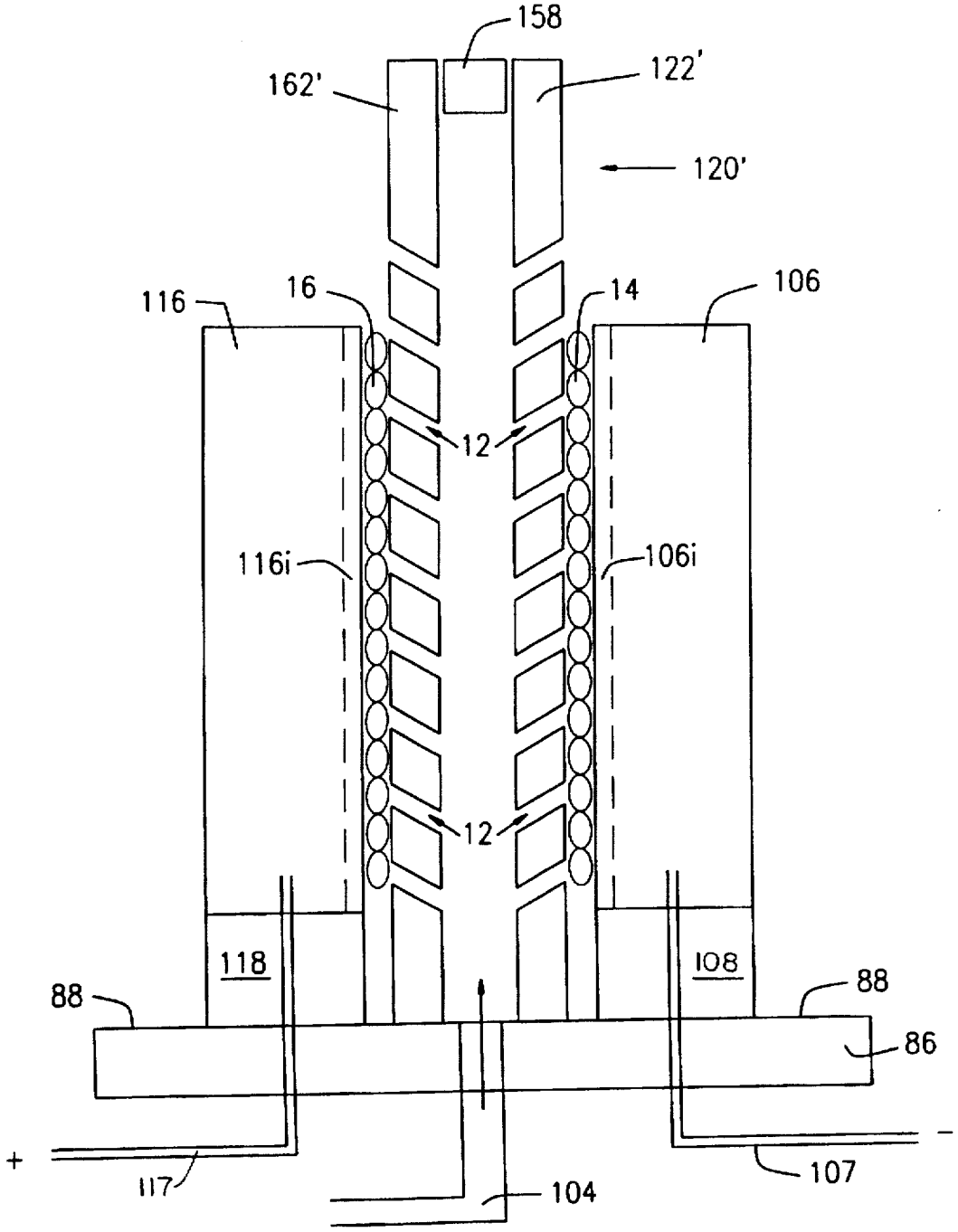
FIG. 10 is a sectional view of the fluorine electrolyzer of the present invention showing an alternate lower barrier configuration in relationship to the anode and cathode electrode placement for proper electrolyte ion flow through the lower barrier.

The TEN divider 120 in the preferred embodiment consists of two one-half of an inch (½") Teflon perforation plates 122 and 162 for a total TEN divider 120 thickness of one inch (1") having the plurality of V-shaped passageways therein with no separation between the anodic and cathodic perforation plates 122 and 162. In alternate embodiments, as shown in FIG. 10, the TEN divider 120' may alternately be assembled with a separation between the anodic and cathodic perforation plates 122' and 162' with the use of a separation plate 158, to allow for the entry of the electrolyte flux solution 12 into the lower liquid electrolyte chamber 84 of electrolyzer chamber 20. This aforementioned configuration also avoids any accumulation or recombination of the fluorine ($F_2$) 14 and hydrogen ($H_2$) 16 gases in lower electrolyte chamber 84 and upper chamber 24 of electrolyzer chamber 20.

Figure 5:
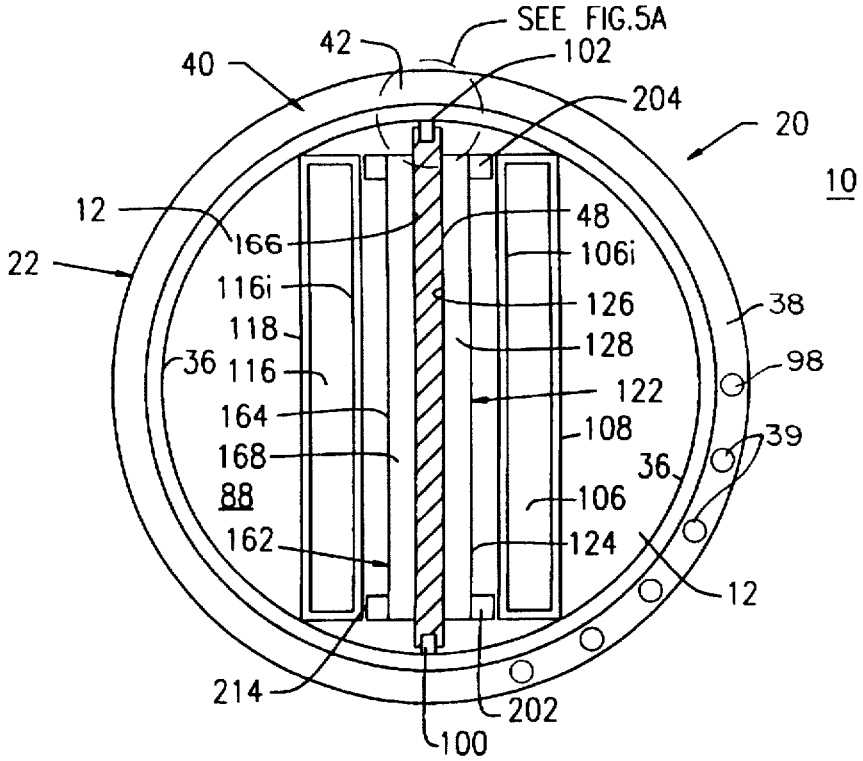
FIG. 5 is a top cross-sectional view of the fluorine electrolyzer taken along lines 5—5 of FIG. 1 of the present invention showing the lower barrier, internal flanges and the anode and cathode electrodes.
Figure 5A:
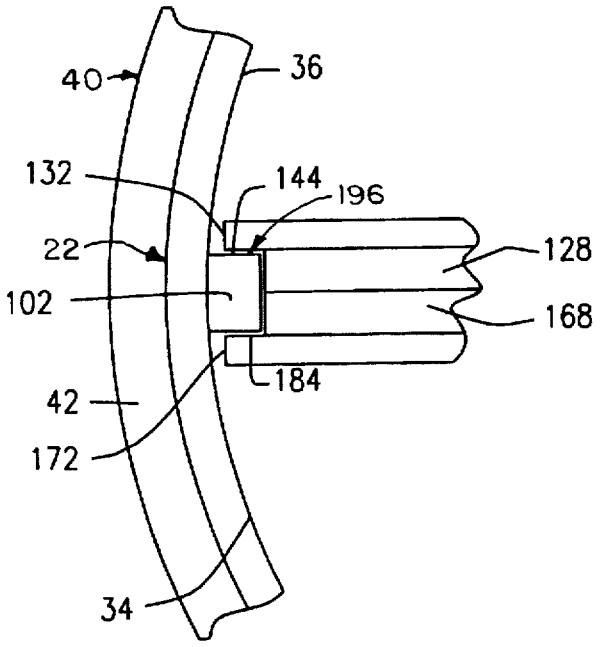
FIG. 5A is an enlarged view of the fluorine electrolyzer of the present invention showing the dove tail guide slot detail for holding the lower barrier in place.
Figure 9A:
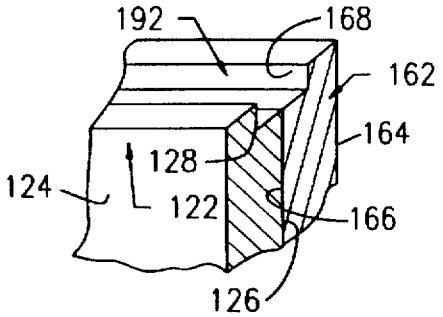
FIG. 9A is a partial top perspective view of the fluorine electrolyzer of the present invention showing the upper guide slot on the lower barrier which joins to the upper barrier within the upper gas chamber of the electrolyzer.
Figure 9B:
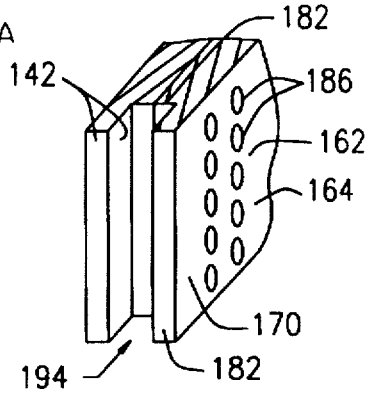
FIG. 9B is a partial side perspective view of the fluorine electrolyzer of the present invention showing the side guide slot on the lower barrier which joins to the vertical flange mounted on the lower liquid electrolyte chamber for holding the lower barrier in place.

In addition, when the rear surfaces 126 and 166 of each perforation plate 122 and 162 are engaged, the upper top L-shaped perimeter edges 128, 168 are joined together to form a guide slot 192 on TEN divider 120 which is used for receiving and joining the lower perimeter edge 49 of metal separator seal plate 48, as shown in FIGS. 3, 4, and 9A of the drawings. Further, when the rear surfaces 126 and 166 of each perforation plate 122 and 162 are engaged, the inner side L-shaped perimeter edges 142, 182, 144, and 184 are joined together, respectively, to form guide slots 194 and 196 on the TEN divider 120 which are used for joining to the 180° opposed vertical flanges 100 and 102 for holding the TEN divider 120 in place, as shown in FIGS. 2, 5, and 9B of the drawings.

Figure 6:
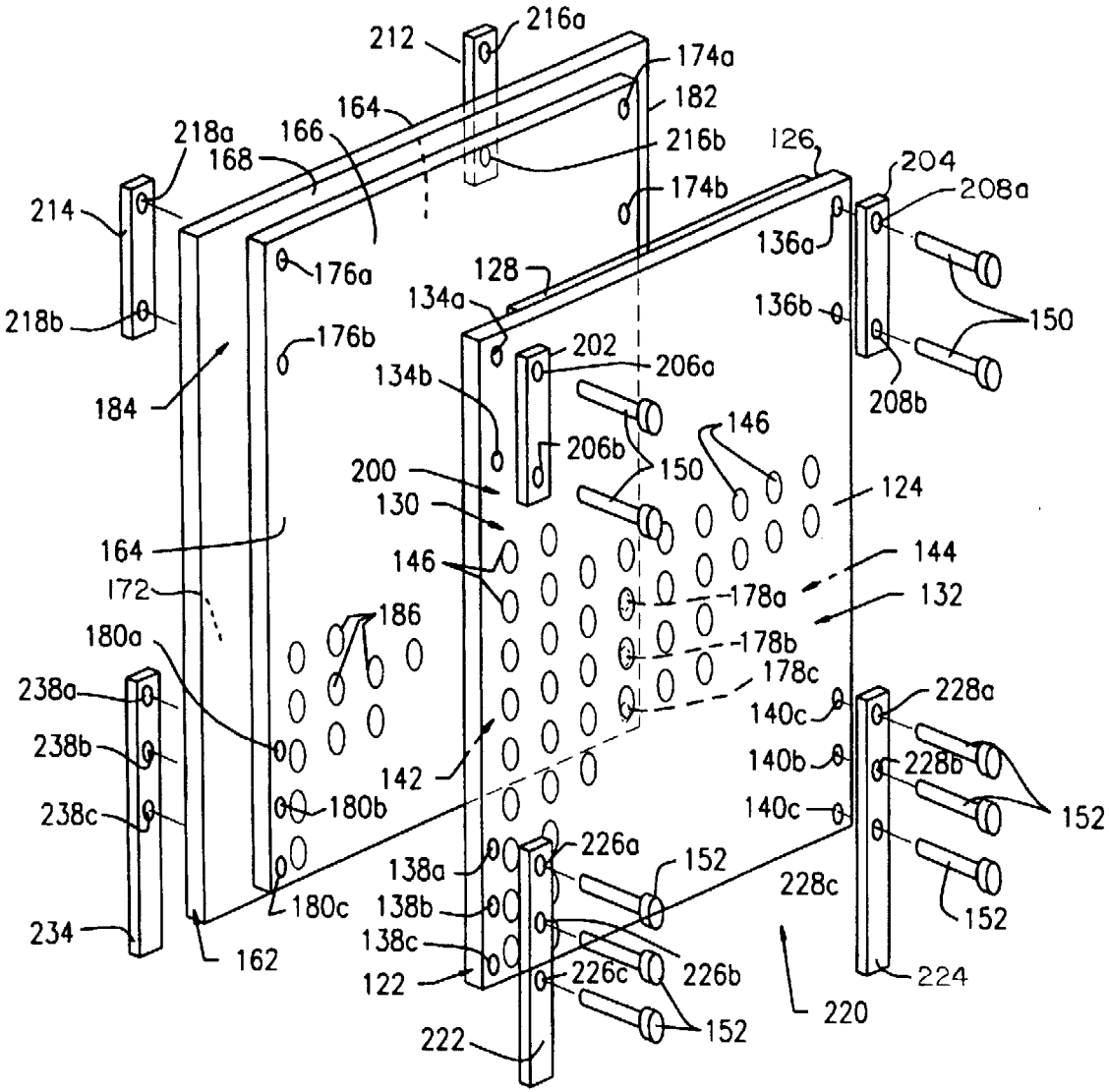
FIG. 6 is an exploded perspective view of the fluorine electrolyzer of the present invention showing the lower barrier and its component parts thereof.
Figure 7:
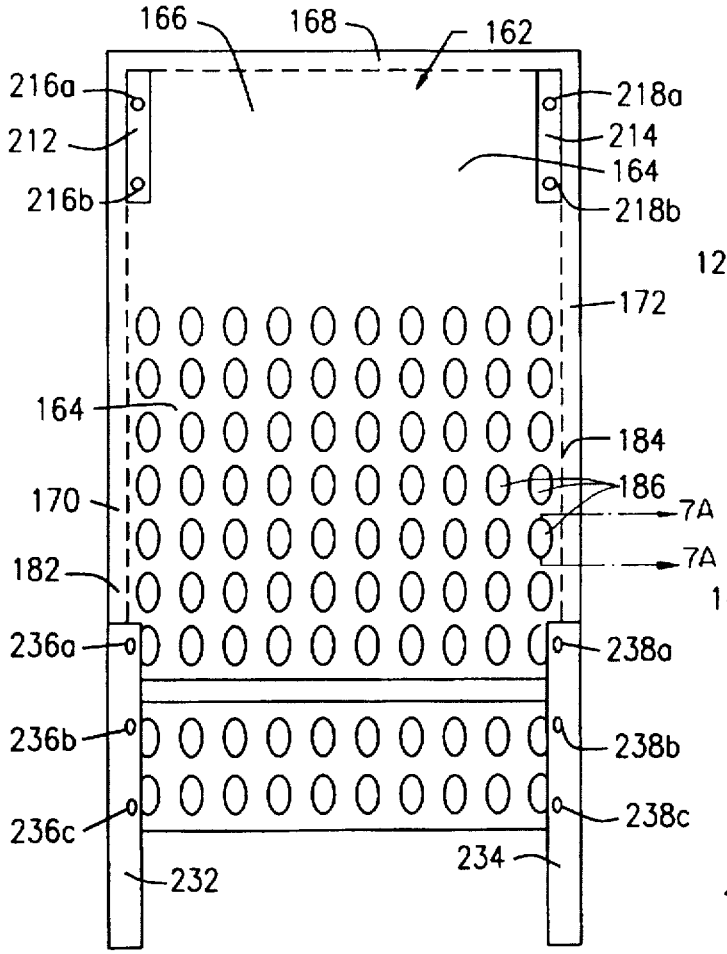
FIG. 7 is a front view of the fluorine electrolyzer of the present invention showing the lower barrier having V-shaped passageways.

TEN divider 120 further includes an upper frame holder 200 and a lower frame holder 220 for securely holding the TEN divider 120 to the metal separator seal plate 48 and to the vertical flanges 100 and 102 connected to the inner surface wall 94 of cylindrical wall section 90. Upper frame holder 200 includes a pair of front and a pair of rear holding bars 202, 204, 212, and 214 having a plurality of recessed cavity openings 206*a*, 206*b*, 208*a*, 208*b*, 216*a*, 216*b*, 218*a*, and 218*b*, respectively, for the holding of bolts 150. Lower frame holder 220 includes a pair of front and a pair of rear holding bars 222, 224, 232, and 234 having a plurality of recessed cavity openings 226*a*, 226*b*, 226*c*, 228*a*, 228*b*, 228*c*, 236*a*, 236*b*, 236*c*, 238*a*, 238*b*, and 238*c*, respectively, for the holding of bolts 152, as shown in FIGS. 3, 4, and 6.

When the upper frame holder 200 is in the assembled position, as shown in FIGS. 3 and 4, front holding bars 202 and 204 are placed on the outer perimeter lip edges 130 and 132 of the front surface 124 of anodic perforated plate 122, such that the recessed cavities 206*a*, 206*b*, 208*a*, and 208*b* of front holding bars 202 and 204 are aligned with the upper hole openings 134*a*, 134*b*, 136*a* and 136*b* of the outer perimeter lip edges 130 and 132, respectively, where bolts 150 are received and inserted within the aforementioned openings. Concurrently, the rear holding bars 212 and 214 are placed on the outer perimeter lip edges 170 and 172 of the front surface 164 of cathodic perforated plate 162, such that the recessed cavities 216*a*, 216*b*, 218*a*, and 218*b* of rear holding bars 212 and 214 are aligned with the lower hole openings 174*a*, 174*b*, 176*a*, and 176*b* of the outer perimeter lip edges 170 and 172, where bolts 150 are received, inserted, and secured within the aforementioned openings, which are then secured tightly to the bottom perimeter edge 49 of the metal separator seal plate 48 via guide slot 190.

Figure 8:
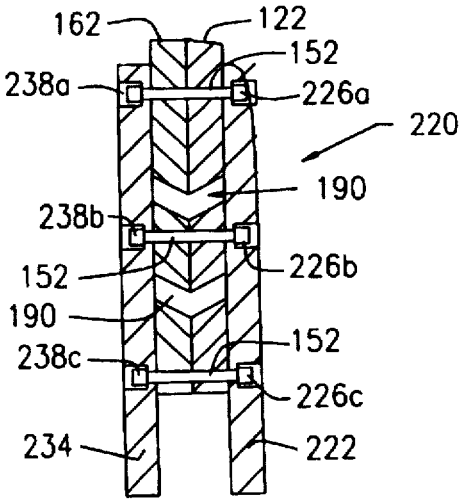
FIG. 8 is a cross-sectional view of the fluorine electrolyzer taken along lines 8—8 of FIG. 1 of the present invention showing the lower bottom frame holder holding the lower barrier in place.

When the lower frame holder 220 is in the assembled position, as shown in FIGS. 3, 4, and 8, front holding bars 222 and 224 are placed on the outer perimeter lip edges 130 and 132 of the front surface 124 of anodic perforated plate 122, such that the recessed cavities 226*a*, 226*b*, 226*c*, 228*a*, 228*b*, and 228*c* of front holding bars 222 and 224 are aligned with the lower hole openings 138*a*, 138*b*, 138*c*, 140*a*, 140*b*, and 140*c* of the outer perimeter lip edges 130 and 132, respectively, where bolts 152 are received and inserted within the aforementioned openings. Concurrently, the rear holding bars 222 and 224 are placed on the outer perimeter lip edges 170 and 172 of the front surface 164 of cathodic perforated plate 162, such that the recessed cavities 236*a*, 236*b*, 236*c*, 238*a*, 238*b*, and 238*c* of rear holding bars 232 and 234 are aligned with the lower hole openings 178*a*, 178*b*, 178*c*, 180*a*, 180*b*, and 180*c* of the outer perimeter lip edges 170 and 172, respectively, where bolts 152 are received, inserted and secured within the aforementioned openings, which are then secured tightly to the vertical wall flanges 100 and 102 via guide slots 192 and 194, respectively.

Fluorine electrolyzer 10 also includes an external heat exchanger and transfer mixing tank 240 to maintain uniform electrolyte composition near the electrode area resulting in uniform electroconductivity. Mixing tank 240 includes a heating coil/jacket 242 having inlet and outlet flux lines 244 and 246; inlet and outlet pumps 248 and 250; and inlet and outlet valves 252 and 254 for controlling the flow of flux solution 12 to the electrolyzer chamber 20, such that the electrolyte flux solution 12 is always above the lower edge of metal separator seal plate 48 for proper electrolyzer operating conditions, as shown in FIGS. 2 and 3 of the drawings. In addition, mixing tank 240 includes an agitator component 256 having an agitator shaft 258 and mixing impeller 260 for thoroughly mixing the electrolyte flux solution 12 from the heating jacket 242.

In addition, as shown in FIG. 1, gas storage holding tank 290 includes an outlet pump 54 for transferring fluorine gas ($F_2$) 14 to other holding vessels (not shown); and gas storage holding tank 292 includes an outlet pump 60 for transferring hydrogen gas ($H_2$) 16 to a gas cylinder 298.

ALTERNATE EMBODIMENTS

Figure 12:
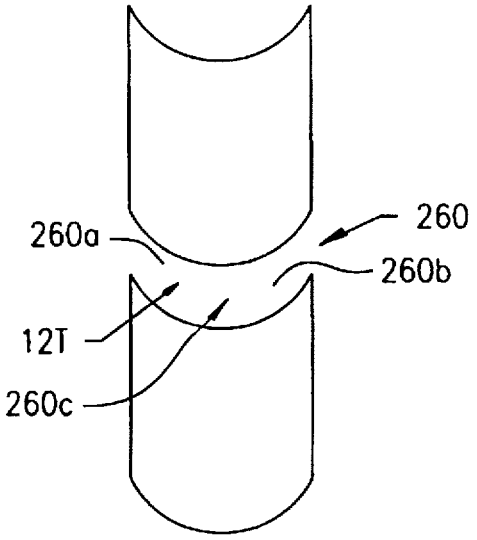
FIG. 12 is a sectional view of the fluorine electrolyzer of the present invention showing as an alternative U-shaped passageways in the lower barrier.
Figure 13:
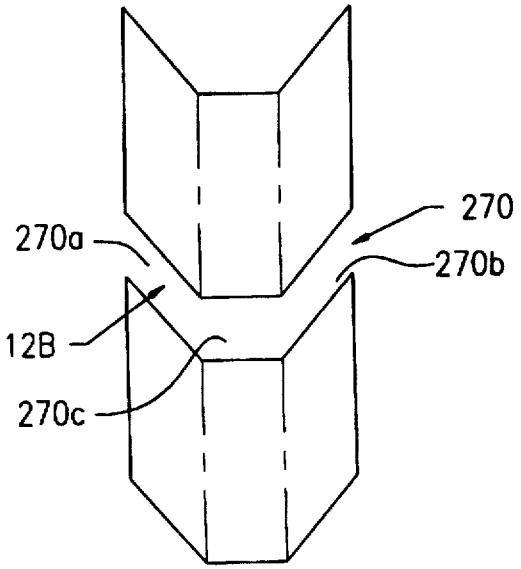
FIG. 13 is a sectional view of the fluorine electrolyzer of the present invention showing alternate passageways in the lower barrier.
Figure 14:
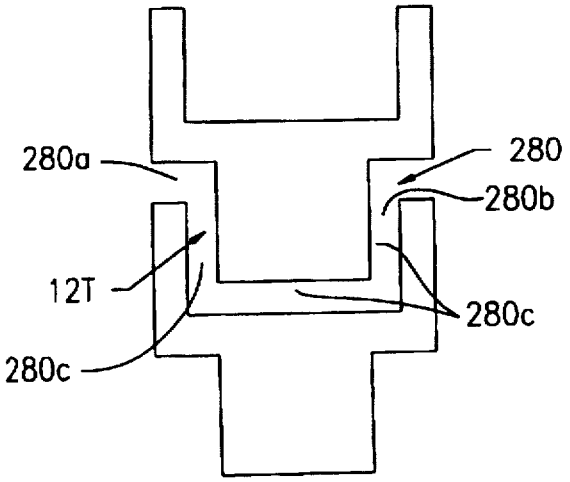
FIG. 14 is a sectional view of the fluorine electrolyzer of the present invention showing alternate passageways in the lower barrier.

FIGS. 12, 13, and 14 show alternate embodiments of the V-shaped passageways 190, and they are designated by reference numerals 260, 270, and 280 in FIGS. 12, 13, and 14. Passageways 190, 260, 270, and 280 all have the common construction of two upper end sections connected by a lower section between them for the passage of electrons while preventing the passages of gases. For example, in FIG. 12, passageway 260 has upper end sections 260*a* and 260*b* connected by a lower section 260*c* between them. Similarly, in FIG. 13, passageway 270 has upper end sections 270*a* and 270*b* connected by a lower section 270*c* between them. Similarly, in FIG. 13, passageway 270 has upper end sections 270*a* and 270*b* connected by a lower section 270*c* between them. Similarly, in FIG. 14, passageway 280 has upper end sections 280*a* and 280*b* connected by a lower end section 280*c* between them.

OPERATION OF THE PRESENT INVENTION

In operating the electrolyzer 10 of the present invention, the operator transfers heated electrolyte flux solution 12 from the mixing tank 240 via outlet flux line 246 and outlet pump 250 to the lower liquid electrolyte chamber 84 of electrolyzer chamber 20 via inlet flux line 104. The electrolyte flux solution 12 used to produce fluorine gas ($F_2$) 14 and hydrogen gas ($H_2$) 16 can be either a binary electrolyte flux solution 12B containing hydrogen fluoride (HF) at 40% to 50% by weight and potassium fluoride (KF) at 50% to 60% by weight, or a ternary electrolyte flux solution 12T containing ammonia ($NH_3$) at 1% to 10% by weight, hydrogen fluoride (HF) at 45% to 65% by weight and potassium fluoride (KF) at 30% to 50% by weight. The electrolyte flux 12 is heated to a range of 120° F. to 180° F. to maintain a uniform electrolyte composition having a uniform electroconductivity when the electrolyte reactive ions are adjacent to the anode and cathode electrodes 106 and 116, respectively.

The electrolyte flux 12 level is initially filled to approximately the (½) point within the upper liquid/gas chamber 24 which is above the upper top guide slot 192 of the TEN divider 120, as shown in FIGS. 3 and 4 of the drawings. The depth of the metal separator seal plate or barrier 48 is equal to the height of the upper chamber 24 and is a function of the required maximum differential pressure $\Delta P_{max}$ during the operation of electrolyzer chamber 20. The maximum allowable differential pressure $\Delta P_{max}$ in the upper gas chamber 24 depends mainly on the initial level of electrolyte flux 12, the depth of seal plate 48, and the total height of the upper gas chamber 24. In the present invention, the electrolyzer chamber 20 is designed to have its minimum electrolyte flux 12 level at six inches (6") above the top guide slot 192 of the TEN divider 120 (or above the flange ring connections 38 and 96 of electrolyzer chamber 20), as shown in FIGS. 3 and 4 of the drawings. However, this height may vary from 6" to 50". As illustrated in FIGS. 3 and 4, if the initial electrolyte flux 12 level, without any pressure differential $\Delta P_n$ between the anodic and cathodic gas compartments 44 and 46, is twenty-four inches (24") from the flange connections 38 and 96, then the maximum allowable differential pressure $\Delta P_{max}$ is reached when there is a forty-eight inch (48") difference in the levels of the electrolyte flux solution 12 between the anode and cathode compartments. This maximum allowable differential $\Delta P_{max}$ is reached when there is a forty-eight inch (48") difference between the minimum electrolyte flux 12 level of zero inches (0") in one of the gas compartments and the maximum electrolyte flux 12 level of forty-eight inches (48") in the other compartment.

The electrolyzer chamber 20 of the present invention has been tested successfully for different maximum pressure differentials with initial electrolyte flux 12 levels between six inches (6") to thirty-six inches (36"). Above thirty-six inches (36"), the height of the upper gas chamber 24 sets a physical limit on the maximum differential pressure $\Delta P_{max}$. During the production of 7 kilograms of fluorine gas ($F_2$) 14 at the rate of 10 grams per hour, the differential pressure $\Delta P_n$ between the anodic and cathodic gas compartments 44 and 46 was allowed to cycle between electrolyte flux 12 levels of zero inches (0") to twenty-four inches (24") several times to observe the operational performance of the electrolyzer 10 of the present invention. The voltage and the current to the electrolyzer chamber 20 remained steady without causing any disturbance to the electroconductivity in flux 12 for the fluorine gas ($F_2$) 14 and hydrogen gas ($H_2$) 16 production in the electrolyzer chamber 20. This production run clearly shows the benefit of the upper gas chamber 24 of electrolyzer chamber 20 in which the produced oxidizer anodic gas of fluorine ($F_2$) 14 had no adverse effect on the electrodes, electrolyte, or on the performance of the electrolyzer, or on the metal plate 48 such that there was no risk of breaking or rupturing of the liquid electrolyte seal (LES) formed by the plate 48 separating the anodic and cathodic gas compartments 44 and 46, thereby preventing an explosion. At the same time, there was absolutely no corrosion near the current input leads 107 and 117 of the anode and cathode electrodes 106 and 116, as electrodes 106 and 116 are located in the bottom wall 86 of lower liquid electrolyte chamber 84 and not in the oxidizer or reducer gaseous environments of the anodic and cathodic gas compartments 44 and 46 of the upper gas chamber 24.

In operation, the upper liquid/gas chamber 24 allows the electrolyzer chamber 20 to be operated under positive gas pressure without disturbing the production of the fluorine gas ($F_2$) 14 and hydrogen gas ($H_2$) 16 at the anode and cathode electrodes 106 and 116 and having a normal differential pressure $\Delta P_n$ of zero (0) to two (2) psig between the internal anodic and cathodic gas compartments 44 and 46. The upper gas chamber 24 also allows for the use of an atmospheric compressor 82 for compressing the fluorine ($F_2$) 14 and hydrogen ($H_2$) 16 gases within each of anodic and cathodic gas compartments 44 and 46, so that the above gases 14 and 16 are compressed to required higher pressures needed for downstream processes without the risk of breaking or rupturing the liquid electrolyte seal (LES) formed by metal separator seal plate 48 in the upper gas chamber 24.

The operator now energizes the electrical current input leads 107 and 117 for each of the anode and cathode electrodes 106 and 116 for producing the fluorine gas ($F_2$) 14 and hydrogen gas ($H_2$) 16 from the binary electrolyte flux solution 12B or ternary electrolyte flux solution 12T in the lower liquid electrolyte chamber 24. When these anodic and cathodic gases are produced, the electrolyzer chamber can have a pressure differential $\Delta P_n$ between the anodic and cathodic gas compartments 44 and 46, as previously discussed. For example, if the cathodic gas (i.e. hydrogen gas ($H_2$) 16) is discharged to the atmosphere and the anodic gas (i.e. fluorine gas ($F_2$) 14) is transported by gas outlet pump 54 to the downstream process or storage holding tank 290, then the anodic gas compartment 44 is at a negative pressure with respect to the atmosphere, as shown in FIG. 3 of the drawings. This in effect causes the liquid electrolyte flux 12 level in the anodic gas compartment 44 to rise, as shown in FIG. 3.

Similarly, in the event of any pressure surge in the cathodic gas compartment 46 due to the filling-up of gas cylinder 298 with hydrogen gas ($H_2$) 16 from the cathodic gas compartment 46 within upper gas chamber 24 or when the cathodic hydrogen gas ($H_2$) 16 is being transported via outlet pump 60, the liquid electrolyte flux solution 12 level in the anodic compartment 44 of upper gas chamber 24 is expected to be lower, as shown in FIG. 4 of the drawings; and FIG. 4 shows the anodic gas compartment 44 at positive pressure with respect to the atmosphere.

In another example, if the anodic gas (i.e., oxygen gas ($O_2$)) is discharged from the anodic gas compartment 44 to the atmosphere and the cathodic gas (i.e., deuterium ($D_2$)) is transported by gas outlet pump 60 to the downstream storage holding tank 292, then the cathodic gas compartment 46 is at a positive pressure with respect to the atmosphere, as depicted in FIG. 3 of the drawings. As shown in FIG. 4, the cathodic gas compartment 46 is at a negative pressure with respect to the atmosphere.

The present invention creates a liquid electrolyte seal (LES) between the two sides of the electrolyzer by starting with a predetermined amount of electrolyte (for example, 24") in both compartments 44 and 46 in the upper chamber 24. The pressure in the two gas compartments 44 and 46 would have to change substantially to move the twenty-four inches (24") of electrolyte from one compartment to the other and create a height differential of forty-eight inches (48") of electrolyte in one compartment and zero height in the other compartment. If this were to occur, the liquid electrolyte seal (LES) would be broken, and the gas from one compartment would pass through the seam or joint 49 between upper barrier 48 and lower barrier 120 and into the other compartment. However, no explosion would occur (as in the prior art) because the gas passing through the seam or joint 49 would enter into the liquid electrolyte 12 that is at the higher level (e.g. 48") in that compartment. Thus, because of the increased height of upper tank 48 and the increased height of the initial electrolyte level (e.g. 24"), the present invention permits a greater height and pressure differential between the two compartments 44 and 46 before the liquid electrolyte seal (LES) is broken. The present invention provides an upper tank or upper liquid/gas chamber 24 to be bolted to the lower tank 84, wherein the upper tank may have a height of 10" to 100", preferably 50". This allows the upper tank 24 to be half filled with electrolyte and allows a greater height and pressure differential between anodic and cathodic gas compartments 44 and 46, and thereby provides the liquid electrolyte seal (LES) discussed above.

Figure 11:
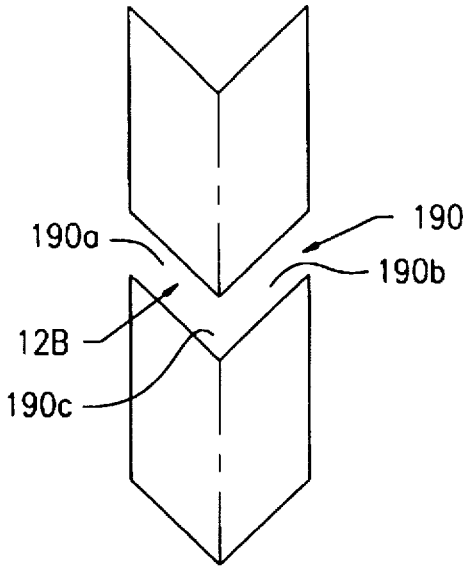
FIG. 11 is a sectional view of the fluorine electrolyzer of the present invention showing V-shaped passageways in the lower barrier.

As previously mentioned, the TEN divider barrier 120 provides the first barrier between the anode and cathode electrodes 106 and 116 in the lower liquid electrolyte chamber 84 in order to prevent the recombination of the anodic and cathodic gases 14 and 16 after their generation at the electrode surfaces **106*a* and 116*a*. The TEN divider 120 does not limit the mobility of the reactive ions (i.e., $H^+$, $F^-$) from the anode electrode 106 to the cathode electrode 116 in the liquid electrolyte flux 12, and further does not introduce any electrical or mass transport resistances at the surface walls 124 and 164 of the perforated plates 122 and 162, respectively, for the flow of reactive ions through the plurality of passageways 190 to the appropriate electrodes 106 and 116 for generation of the fluorine ($F_2$) 14 and hydrogen ($H_2$) 16 gases at electrode surfaces 106*a* and 116*a*, as shown in FIGS. 10 and 11. The principle on which the TEN divider 120 performs its reactive ion transfer is that electrolyte reactive ions can travel through the V-shaped passageways 190 to each of the respective electrodes 106 and 116, but the anodic and cathodic gases 14 and 16 have a much lower density than the liquid electrolyte flux solution 12 density, such that the anodic and cathodic gases cannot flow downwardly and upwardly through the plurality of V-shaped passageways 190 to the appropriate electrodes 106 and 116 to form the anodic and cathodic gases 14 and 16, and the gases cannot recombine. Moreover, if any gases are forced through the TEN barrier 120, they mix with electrolyte 12**, so the gases do not react with each other.

In operation, the surface areas of the tunnel openings 146 and 186 in the front surface walls 124 and 164 of TEN divider 120 which face the inner surface **106*i* and 116*i* of the electrodes 106 and 116, respectively, are a very important physical parameter that controls the flow of electrons via the reactive ions between the electrodes 106 and 116 through the V-shaped passageways 190 without allowing any gas accumulation in the tunnels or passageways 190 for recombination. The surface area of the tunnel openings 146 and 186 are in the range of 0.1 square inches to 0.5 square inches, such that the surface area of tunnel openings 146 and 186 may be in the range of 10% to 50% of the inner surface area 106*i* and 116*i* of each electrode 106 and 116. The TEN divider 120 assembled for use in the present invention has a tunnel opening surface area of 15% in comparison to the actual inner surface area 106*i* and 116*i* of electrodes 106 and 116, as shown in FIGS. 5 and 10**.

The electrolyzer chamber 20 in the present invention has been operated for over 700 man-hours with no operational problems with regard to the liquid electrolyte seal or the TEN divider plate 120 within the upper liquid/gas chamber 24 and lower liquid electrolyte chamber 84, respectively. There was no corrosion or degradation to the seal plate 48 or the TEN divider barrier 120. In general, the improved electrolyzer 10 of the present invention having the first and second barriers (TEN divider 120 and metal separator seal plate 48) within the lower and upper chambers 84 and 24 of electrolyzer chamber 20 can be utilized in any commercial electrolysis process so that generating various oxidizer gases, such as ozone ($O_3$), oxygen ($O_2$), fluorine ($F_2$), chlorine ($Cl_2$), and nitrogen trifluoride ($NF_3$), can be done in a safe and efficient manner.

ADVANTAGES OF THE PRESENT INVENTION

Accordingly, an advantage of the present invention is that it provides for an improved electrolyzer having an upper liquid/gas chamber with anodic and cathodic gas compartments being separated by a solid baffle, and a lower liquid electrolyte chamber having a barrier with V-shaped passageways such that the electrolyzer is operated with improved safety, capacity, and savings in operational cost for the manufacture of fluorine and other anodic gases (oxidizers) and by having less downtime.

Another advantage of the present invention is that it provides for an improved electrolyzer having a barrier in the electrolyte chamber that prevents explosions, such that the barrier prevents the recombination of the anodic and cathodic gases within the electrolyte solution and/or near the electrodes.

Another advantage of the present invention is that it provides for an improved electrolyzer having a barrier in the electrolyte chamber with a plurality of V-shaped passageways which allows for the free flow of electrons required for the electrolysis via active electrolyte reactant ions without introducing electrical resistance, but prevents the recombination of anodic and cathodic gases.

Another advantage of the present invention is that it provides for an improved electrolyzer having a barrier in the form of a tunnel electron net divider in the electrolyte chamber made of a polymeric material such as polyethylene, polypropylene, polytetrafluoroethylene, polyvinylidine fluoride and the like, and which may be incorporated into any electrolyzer that is charged with any type of electrolyte (hydrous or anhydrous) solutions.

Another advantage of the present invention is that it provides for an improved electrolyzer for the manufacture and production of chemical gases (fluorine, nitrogen trifluoride and hydrogen), such that a change in liquid levels in the electrolyzer will allow a greater pressure differential between the gas compartments and prevent a rupture of the liquid electrolyte seal.

Another advantage of the present invention is that it provides for an improved electrolyzer having a lower liquid electrolyte chamber with electrode connections at the bottom or on the sides of the electrolyzer wall which provides the necessary height for the liquid electrolyte above the electrodes, and which allows for a sufficient pressure differential pressure between the two gas compartments in which to operate safely but also prevents corrosion at the anodic current input point.

Another advantage of the present invention is that it provides for an improved electrolyzer having an upper liquid gas chamber with a cooling zone above the electrodes that reduces the anodic gas temperature and also allows the electrolyte flux solution temperature to be controlled.

Another advantage of the present invention is that it provides for an improved electrolyzer having an upper gas chamber with connections for gaseous streams, electronic sensors, and instruments.

Another advantage of the present invention is that it provides for an improved electrolyzer having an upper liquid gas chamber with a baffle solid barrier which allows for a maximum pressure differential (AP) and minimizes the possibility of any recombination of the anodic and cathodic gases that could cause an explosion.

A further advantage of the present invention is that it provides for an improved electrolyzer having an external heat exchanger/transfer mixing tank to maintain a uniform electrolyte composition near the electrode area resulting in uniform electroconductivity.

An even further advantage of the present invention is that it provides for an improved electrolyzer that is simple to manufacture and assemble; more cost efficient in operational use than previously used electrolyzers; and is readily affordable by the gas manufacturer/producer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An electrolyzer, comprising:

a) a lower electrolyte chamber for receiving liquid electrolyte flux and having disposed therein anode and cathode electrodes for producing anodic and cathodic gases;

b) a first barrier disposed in said lower electrolyte chamber between said anode and cathode electrodes having a plurality of passageways for allowing the passage of electrons but for preventing the recombination of anodic and cathodic gases;

c) an upper liquid/gas chamber having an anodic gas compartment and a cathodic gas compartment for receiving therein the anodic and cathodic gases produced in said lower electrolyte chamber;

d) a second barrier disposed between said anodic and cathodic gas compartments having no passageways in order to prevent the recombination of anodic and cathodic gases, said second barrier being connected to said first barrier; and e) means for transferring the anodic and cathodic gases produced in said anodic and cathodic gas compartments to holding tanks for storing said gases.

2. An electrolyzer in accordance with claim 1, wherein said plurality of passageways are V-shaped for the passage of electrons within said electrolyte flux.

3. An electrolyzer in accordance with claim 1, wherein said plurality of passageways are U-shaped for the passage of electrons within said electrolyte flux.

4. An electrolyzer in accordance with claim 1, wherein said plurality of passageways each have two upper sections on their ends connected by a lower section between said upper sections for the passage of electrons within said electrolyte flux.

5. An electrolyzer in accordance with claim 1, wherein said plurality of passageways are arranged in columns and rows for the passage of electrons within said electrolyte flux.

6. An electrolyzer in accordance with claim 1, wherein said first barrier is made of a polymeric compound selected from the group consisting of polyethylene, polypropylene, polytetrafluoroethylene, polyvinylidine fluoride and equivalent polymeric compounds thereof.

7. An electrolyzer in accordance with claim 1, wherein said first barrier is made of plates arranged parallel to each other and includes means for connecting said plates at different spaced-apart distances.

8. An electrolyzer in accordance with claim 7, further including means for connecting said first and second barriers.

9. An electrolyzer in accordance with claim 1, wherein said second barrier is made of a metal selected from the group consisting of nickel, nickel alloy, monel, stainless steel, Hastelloy, carbon steel, and Inconel.

10. An electrolyzer in accordance with claim 1, wherein said second barrier is made of a solid material to withstand a maximum pressure differential (AP) between said anodic gas compartment and said cathodic gas compartment.

11. An electrolyzer in accordance with claim 1, wherein said upper liquid/gas chamber further includes a plurality of sensors for sensing temperature, pressure and liquid levels of said electrolyte flux within each of said anodic and cathodic gas compartments.

12. An electrolyzer in accordance with claim 1, wherein said lower electrolyte chamber receives liquid electrolyte flux which is selected from the group consisting of a binary electrolyte flux and a ternary electrolyte flux.

13. An electrolyte in accordance with claim 12, wherein said binary electrolyte flux contains hydrogen fluoride (HF) at 40% to 50% by weight and potassium fluoride (KF) at 50% to 60% by weight.

14. An electrolyzer in accordance with claim 12, wherein said ternary electrolyte flux contains ammonia ($NH_3$) at 5% to 10% by mole, hydrogen fluoride (HF) at 65% to 75% by mole, and potassium fluoride (KF) at 20% to 25% by mole.

15. An electrolyzer in accordance with claim 1, wherein said upper chamber receives the anodic gas which is an oxidizer gas selected from the group consisting of fluorine ($F_2$), chlorine ($Cl_2$), oxygen ($O_2$), ozone ($O_3$), and nitrogen trifluoride ($NF_3$).

16. An electrolyzer in accordance with claim 1, wherein said upper chamber receives the cathodic gas which is a reducer gas selected from the group consisting of hydrogen ($H_2$) and deuterium ($D_2$).

17. An electrolyzer in accordance with claim 1, wherein said anode electrode is made from a metal, such as nickel, and is mounted on a base made from an electrical insulation material, such as high density polyethylene, for the prevention of corrosion of said anode electrode.

18. An electrolyzer in accordance with claim 1, wherein said cathode electrode is made from a metal, such as carbon steel, and is mounted on a base made from an electrical insulation material, such as high density polyethylene, for the prevention of corrosion of said cathode electrode.

19. An electrolyzer in accordance with claim 1, further including a heat exchanger and a transfer mixing tank for heating said electrolyte flux in the range of 140° to 180° F. to maintain a uniform electrolyte composition having a uniform electroconductivity adjacent to said anode and cathode electrodes.

20. An electrolyzer in accordance with claim 1, further including means for detachably connecting said lower electrolyte chamber and said upper liquid/gas chamber.

21. An electrolyzer in accordance with claim 1, wherein said passageways have an angle in the range 15° to 75° degrees relative to a horizontal axis and a preferred angle of 45° degrees relative to an horizontal axis.

22. An electrolyzer in accordance with claim 1, further including means for cooling said anodic and cathodic gases in said anodic and cathodic gas compartments.

23. An electrolyzer in accordance with claim 1, wherein said upper liquid/gas chamber has a height in the range of 10" to 100" so as to increase the pressure differential between said anodic and cathodic gas compartments.

24. An upper chamber for attachment to an electrolyzer, comprising:

a) said electrolyzer having a lower electrolyte chamber for receiving liquid electrolyte flux and having disposed therein anode and cathode electrodes for producing anodic and cathodic gases;

b) a first barrier disposed in said lower electrolyte chamber between said anode and cathode electrodes;

c) said upper liquid/gas chamber for attachment to said lower electrolyte chamber and having a height in the range of 10" to 100";

d) said upper chamber having an anodic gas compartment and a cathodic gas compartment for receiving therein the anodic and cathodic gases produced in said lower electrolyte chamber; and e) a second barrier disposed between said anodic and cathodic gas compartments having no passageways in order to prevent the recombination of anodic and cathodic gases, said second barrier being connected to said first barrier.

25. An electrolyzer in accordance with claim 24, further including means for connecting said first and second barriers.

26. An electrolyzer in accordance with claim 24, wherein said second barrier is made of a metal selected from the group consisting of nickel, nickel alloy, monel, stainless steel, Hastelloy, carbon steel, and Inconel.

27. An electrolyzer in accordance with claim 24, wherein said second barrier is made of a solid material to withstand a maximum pressure differential ($\Delta P$) between said anodic gas compartment and said cathodic gas compartment.

28. An electrolyzer in accordance with claim 24, wherein said upper liquid/gas chamber further includes a plurality of sensors for sensing temperature, pressure and liquid levels of said electrolyte flux within each of said anodic and cathodic gas compartments.

29. An electrolyzer in accordance with claim 24, further including means for detachably connecting said lower electrolyte chamber and said upper liquid/gas chamber.

* * * * *

UNITED STATES PATENT AND TRADEMARK OFFICE

CERTIFICATE OF CORRECTION

PATENT NO. :5,779,866

DATED : July 14, 1998

INVENTOR(S) :GREGORIO TARANCON

It is certified that error appears in the above—identified patent and that said Letters Patent is hereby corrected as shown below:

Column 3, line 24, change "(AP)" to --(ΔP)--.

Column 4, line 7, change "(AP)" to --(ΔP)--.

Column 14, line 6, change "(AP)" to --(ΔP)--.

Column 15, line 14, change "(AP)" to --(ΔP)--.

Signed and Sealed this

Twenty-seventh Day of October, 1998

*Attest:*

Bruce Lehman

BRUCE LEHMAN

*Attesting Officer*

*Commissioner of Patents and Trademarks*